United States Patent [19]

Straumsnes

[11] Patent Number: 4,723,381

[45] Date of Patent: Feb. 9, 1988

[54] PREFABRICATED MULTIPLE DWELLING

[76] Inventor: O. Robert Straumsnes, 90 Bryant Ave., White Plains, N.Y. 10605

[21] Appl. No.: 910,067

[22] Filed: Sep. 22, 1986

[51] Int. Cl.[4] ..... E04B 1/16; E04B 1/348

[52] U.S. Cl. ..... 52/79.12; 52/745

[58] Field of Search ..... 52/79.1, 79.2, 79.3, 52/79.12, 79.11, 79.5, 745, 126.3

[56] References Cited

U.S. PATENT DOCUMENTS

| | | | |
|---|---|---|---|
| 2,977,960 | 4/1961 | Farrar | 52/79.1 |
| 3,395,502 | 8/1968 | Frey | 52/79.13 |
| 3,500,595 | 3/1970 | Bennett | 52/79.13 |
| 3,792,558 | 2/1974 | Berce | 52/79.5 |
| 3,822,519 | 7/1974 | Antoniou | 52/79.13 |
| 3,881,571 | 5/1975 | Moulton | 52/79.3 |
| 4,059,931 | 11/1977 | Mongan | 52/79.12 |
| 4,073,100 | 2/1978 | Di Giovanni | 52/79.13 |

FOREIGN PATENT DOCUMENTS

| | | | |
|---|---|---|---|
| 491054 | 2/1976 | Australia | 52/79.1 |
| 2136630 | 2/1973 | Fed. Rep. of Germany | 52/79.1 |
| 2630120 | 1/1978 | Fed. Rep. of Germany | 52/79.12 |
| 1406672 | 6/1965 | France | 52/79.1 |

*Primary Examiner*—John E. Murtagh

*Attorney, Agent, or Firm*—Howard M. Schwinger

[57] ABSTRACT

An assemblage of interconnected mobile homes mounted one above the other consisting of a supporting framework for the assemblage, the framework including oppositely disposed pairs of tracks, each home being provided with oppositely disposed pairs of runners, the runners being adapted to mate with the tracks and slide therein to move the home into final position and be securely clamped thereby.

3 Claims, 4 Drawing Figures

PREFABRICATED MULTIPLE DWELLING

This invention relates to prefabricated housing and more particularly to the construction of a multiple dwelling consisting of a plurality of conventional prefabricated units otherwise known as mobile homes.

The economic advantages of prefabricated housing have long been appreciated and the mobile home has long been with us. However, the many possibilities offered by the mobile home have never been fully realized, particularly with respect to multiple dwelling construction.

It is therefor amongst the primary objects of the present invention to provide for the consolidation of a plurality of mobile homes into a single multiple dwelling.

It is another important object of the present invention to provide a rapid, simple and thus inexpensive way of constructing multiple dwelling housing without compromising the essentials of sound construction.

Other objects and advantages of the present invention will become apparant from a reading of the following specification and drawing wherein:

FIG. 1 is a perspective view showing a housing unit just prior to mounting on the supporting frame, FIG. 2 is a diagrammatic view showing the relationship of runners and tracks, FIG. 3 is an elevation view of a portion of an addembled unit and FIG. 4 shows one of the details of the construction.

DETAILED DESCRIPTION OF THE INVENTION

Figure 1:
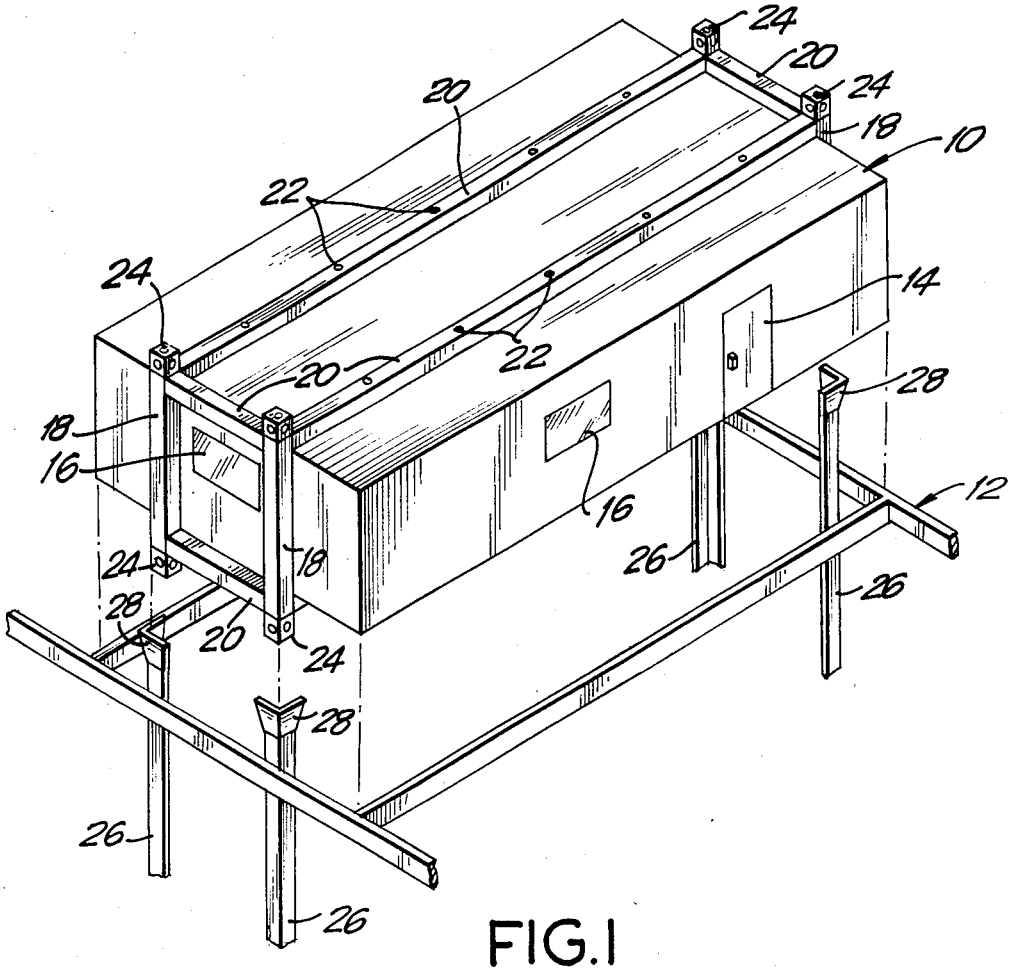
Figure 2:
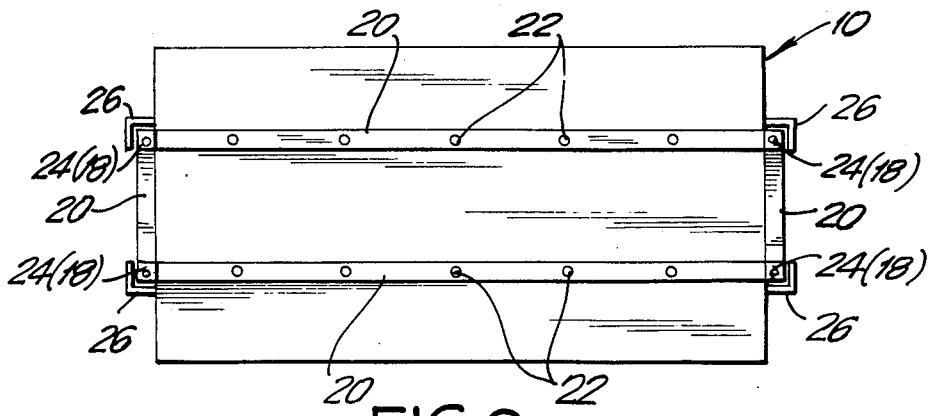

Referring now to the drawings, in FIG. 1 there is shown housing unit 10 positioned above supporting frame 12. Frame 12 is an assemblage of mutually supporting members combined in a manner to provide optimum support for a structure to be carried by it.

In this embodiment of the invention housing unit 10 is a conventional mobile home provided with a door 14, windows 16 and other of the usual accoutrements. Unit 10 is provided at each of its ends with a pair of vertical runners 18. The runners are supported by braces 20 at the top and bottom of the housing unit and at its sides. It is to be noted that the runners are positioned intermediate of the corners of the housing unit having projections 24 which extend above and below the top and bottom sides of the housing unit. The runners and its supporting braces are securely bolted to the housing unit as at 22.

Frame 12 is provided with L-shaped tracks 26 to receive runners 18 of the housing unit. Thus the housing unit may ride the tracks downwardly for several stories before settling in position and one housing unit may be stacked upon another housing unit to create the multiple dwelling. Housing units additionally may be positioned in side by side as well as stacked relationship.

Figure 3:
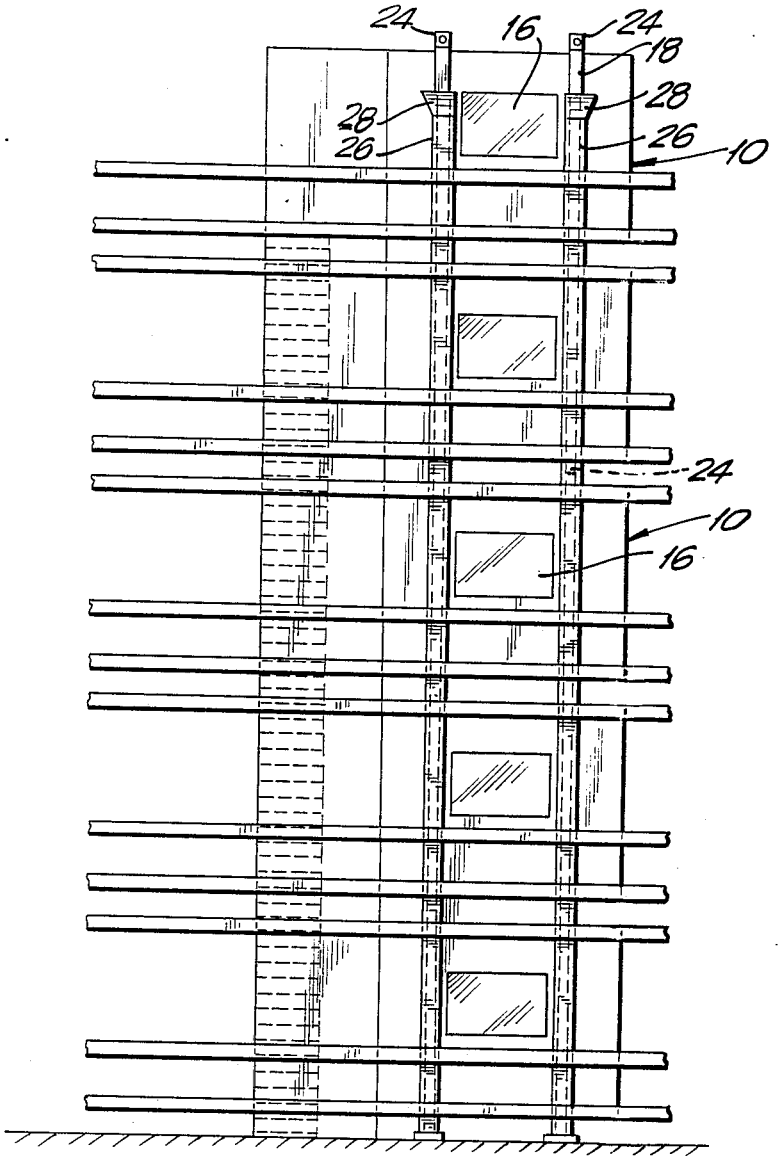
Figure 4:
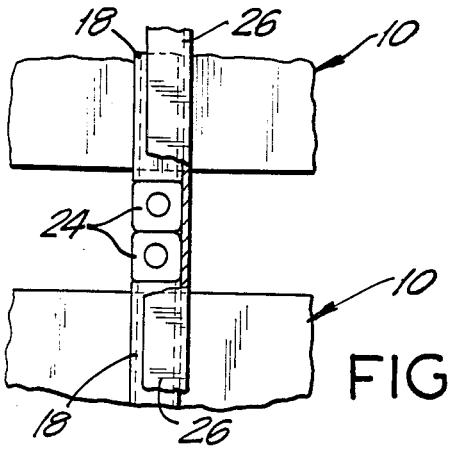

The ends of the tracks may be flared as at 28 to facilitate the insertion of the runners in the tracks. It is to be further noted that the projections 24 of opposed units abut each other to support one housing unit upon the other as is shown in FIG. 4. Each housing unit may carry a patio and stairs for interconnection with a lower level as may be see in FIG. 3. Provision of course may be readily made for plumbing and electrical lines.

It is to be realized that the embodiment herein described is but one of many that can utilize the principles of this invention and it is not intended to limit the invention to the specific embodiment herein shown as the invention encompasses all embodiments falling within the spirit of the appended claims

I claim:

1. An assemblage of interconnected mobile homes mounted one above the other comprising a supporting framework, said framework including a plurality of continuous vertical tracks, each home being provided with vertical runners intermediate its vertical corners, said runners being adapted to mate with the tracks and slide therealong to be moved into desired position, said tracks being of a length sufficient to accommodate a plurality of homes, an upper unit clamping the one beneath it in stacked relationship.

2. An assemblage of interconnected mobile homes mounted one above the other comprising a supporting framework, said framework including a plurality of continuous vertical tracks, each home being provided with vertical runners intermediate its vertical corners, said runners being adapted to mate with the tracks and slide therealong to be moved into desired position, said runners being braced by members disposed therebetween, said tracks being of a length sufficient to accommodate a plurality of homes, the runners of one unit resting on the runners of the unit beneath it, an upper unit clamping the one beneath it in stacked relationship.

3. A stackable mobile home comprising a home provided with vertical runners intermediate its vertical corners, said runners extending above and below the home and adapted to slide in continuous vertical tracks forming a supporting frame so that homes may be mounted one above the other and side by side, the ends of the runners of one unit resting upon the ends of the runners of the unit beneath it, said runners being braced by members disposed therebetween.

* * * * *